US006065982A

United States Patent [19]

Okabe

[11] Patent Number: 6,065,982

[45] Date of Patent: May 23, 2000

[54] LEVER-ENGAGED CONNECTOR

[75] Inventor: Toshiaki Okabe, Shizuoka, Japan

[73] Assignee: Yazaki Corporation, Tokyo, Japan

[21] Appl. No.: 09/135,559

[22] Filed: Aug. 18, 1998

[30] Foreign Application Priority Data

Aug. 18, 1997 [JP] Japan ..... 9-221579

[51] Int. Cl.[7] ..... H01R 13/62

[52] U.S. Cl. ..... 439/157

[58] Field of Search ..... 439/157, 152, 439/372, 155

[56] References Cited

U.S. PATENT DOCUMENTS 5,681,175 10/1997 Busse ..... 439/157

5,711,682 1/1998 Maejima ..... 439/157

*Primary Examiner*—Khiem Nguyen

*Assistant Examiner*—Javaid Nasri

*Attorney, Agent, or Firm*—Sughrue, Mion, Zinn, Macpeak & Seas, PLLC

[57] ABSTRACT

In a lever-engaged connector 20, a lever 27 is rotatably held between both side walls 39 and 39 of a connector body 25 and inner walls 50 and 50 of a hood 22. The connector 20 comprises: a pair of lever walls 51 for regulating the bending of cover members 41 and 41; protrusions 52 and 52 which are extended from the pair of lever walls 51 and 51 on one side, and, when the connector body is fitted in the hood 22, engage with the hood 22; and an operating section 53 through which the other sides of the lever walls 51 and 51 are coupled to each other, and which turns the lever walls 51 and 51 around the locking portions of the protrusions 52 and 52 where the protrusions are locked to the hood 22, to cause the connector body 25 to fit in the hood 22, whereby the bending of the cover members 41 and 41 is positively prevented.

4 Claims, 7 Drawing Sheets

LEVER-ENGAGED CONNECTOR

BACKGROUND OF THE INVENTION

1. Technical Field of the Invention

This invention relates to a lever-engaged connector in which male and female connectors are engaged with each other by operating a lever.

2. Discussion of the Prior Art

FIG. 10 shows a frame-coupled connector 1 which has been disclosed by Japanese Patent Unexamined Publication No. Hei 6-251826. The connector 1 comprises a female connector section 3 provided on a junction box body 2 (shown in FIG. 11) such as an electrical junction box, male connectors 5 fitted in the hood 4 of the female connector section 3, and a frame 6 fit the male connectors 5 in the female connector section 3. The frame 6 comprises a body 7 in which the male connectors 5 are swingably provided, a swing leg 8 protruded from one side of the body 7, and an operating protrusion 9 protruded from the other side of the body 7. The swing leg 8 has a slide shaft 10 at the end. The slide shaft 10 is fixedly inserted in a slide groove 12 formed in a frame supporting section 11 which is formed around the female connector section 3.

As shown in FIG. 11, with the slid shaft 10 fitted in the slide groove 12, the operating protrusion 9 is depressed in the direction a so that the male connector 5 are engaged with the female connector section 3. The male connectors 5 are disengaged from the female connector section 3 as follows: The operating protrusion 9 is pushed in a direction opposite to the direction a to swing the frame 6 also in a direction opposite to the direction a thereby to pull the male connectors 5 out of the hood 4 of the female connector section 3.

In this operation, the slide shaft 10 is a fulcrum while the operating protrusion 9 is a force point, and therefore an action point is defined by each of the supporting portions of the male connectors 5, which is swingably supported. This relationship makes the male connectors 5 be engaged with the female connector section 3 with a small force. That is, the engagement of the male connectors 5 with the female connector section 3 can be achieved with a small force.

The above-described frame-coupled connector 1 suffers from the following difficulty: During operation, the side wall 7*a* is bent outwardly, so that the portions 100 which swingably support the male connectors are liable to come off.

Furthermore, as shown in FIGS. 12 and 13, in the case of a male connector 14 having a cover member 13 on the side surface of a wire lead-out side; that is, in the case of a connector of that type that it accommodates a crimp terminal 15 suffers from the following difficulty. That is, as shown in FIG. 13, when a wire is laid, the cover member 13 is liable to bend outwardly; that is, it is liable to be deformed. Hence, when the connector is operated, the body 7 is more liable to be bend outwardly.

Furthermore, when the wire 16 is laid, the cover member 13 is liable to bend. Hence, as shown in FIG. 14, the crimp terminal 15 is deformed.

SUMMARY OF THE INVENTION

In view of the foregoing, an object of the invention is to provided a lever-engaged connector of the type that a male connector with a cover member is engaged with a female connector section with a lever, in which the lever is prevented from coming off, and the bending of the cover members is regulated.

The foregoing object and other objects have been achieved by the provision of a lever-engaged connector comprising:

a female connector having a hood with recessed portions and a housing accommodating terminals, the hood and the housing being integrally formed;

a male connector including a connector body which has terminal accommodating chambers for accommodating the mating terminals to be connected to the terminal and a cover member for covering the terminal accommodating chambers, the cover member being disposed on a wire-lead-out side of the terminal accommodating chambers; and a lever for inserting the connector body of the male connector in the hood and removing the connector body from the hood, wherein the lever comprising:

a pair of lever walls for preventing the cover members from bending, the lever walls are rotatably interposed between both side walls of the connector body and inner walls of the hood, protrusions formed on one side of the pair of lever walls for engaging with recessed portions of the hood when the connector body is fitted in the hood, and an operating portion through which the other sides of the lever walls are coupled to each other, and which turns the lever walls around contacting portions of the protrusions where the protrusions are contacted with the recessed portions of the hood, to cause the connector body to fit in the hood.

In the above-mentioned lever-engaged connector, preferably, the cover members are provided on both side surfaces of the connector body, and the bending of the cover members is prevented by the pair of lever walls.

In addition, in the above-mentioned lever-engaged connector, advantageously, the connector body has guide slits into which the protrusions of the lever walls are inserted for guiding protrusions when the lever walls are turned.

With the connector, when the wires pulled out of the wire pull-out side of the connector body are pulled or twisted, the cover members tend to bend outwardly; however, the bending is regulated by the lever walls. Furthermore, the lever walls are rotatably held between both side walls of the connector body and the inner walls of the hood, and therefore even if the lever walls tend to bend outwardly, the bending is prevented by the inner walls of the hood. As a result, even if the cover members tend to bend outwardly to push the lever walls outwardly, the bending of the lever walls is regulated by the inner walls of the hood. This means that the bending of the cover members is prevented.

In the lever-engaged connector, the cover members may be provided on both side surfaces of the connector body so that the bending of the cover members is prevented by the pair of lever walls. In the connector, the bending of the cover member covering both side surfaces of the connector body is prevented by the pair of the lever walls, and the bending of the pair of lever walls is regulated by the inner walls of the hood. As a result, the bending of the cover members is regulated, whereby the connector is free from difficulty that the cover members are bent when the wires are pulled or twisted.

Furthermore, in the lever-engaged connector, the connector body has guide slits in which the protrusions of the lever walls are inserted to guide the protrusions when the lever walls are turned.

In the connector, when the lever walls are turned with the locking portions of the protrusions as fulcrums, the protrusions of the lever walls are swung while being guide by the guide slits formed in the connector body. In this case, even before the connector body is fitted in the hood, the protrusions of the lever walls have been inserted in the guide slits.

Therefore, even if, under this condition, the wires are pulled or twisted, the bending of the cover members can be positive prevented.

The nature, utility and principle of the invention will be more clearly understood from the following detailed description and the appended claims when read in conjunction with the accompanying drawings.

DETAILED DESCRIPTION OF THE INVENTION

A lever-engaged connector, an embodiment of the invention, will be described with reference to the accompanying drawings.

Figure 1:
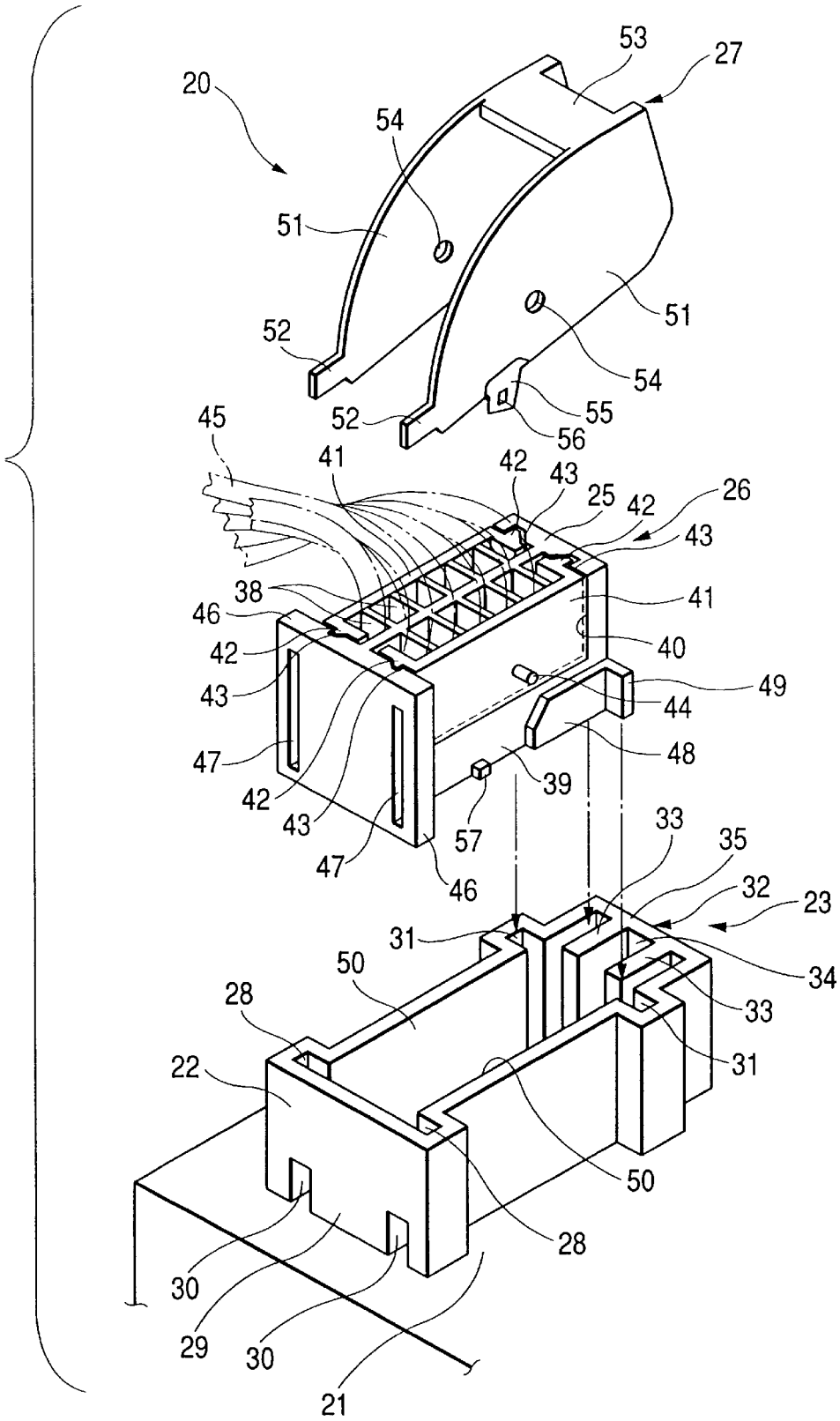
FIG. 1 is an exploded perspective view of a lever-engaged connector, which is an embodiment of the invention.
Figure 2:
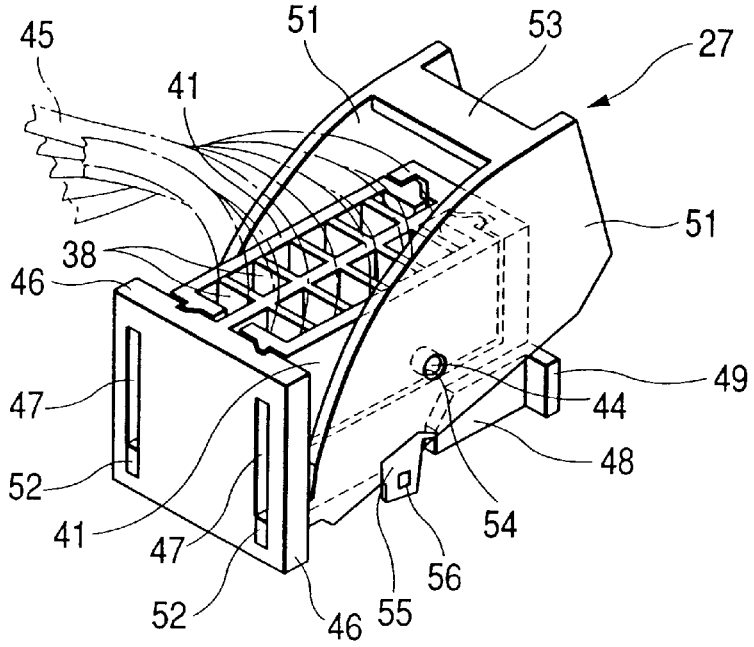
FIG. 2 is a perspective view showing relationships between a male connector and a lever.
Figure 3:
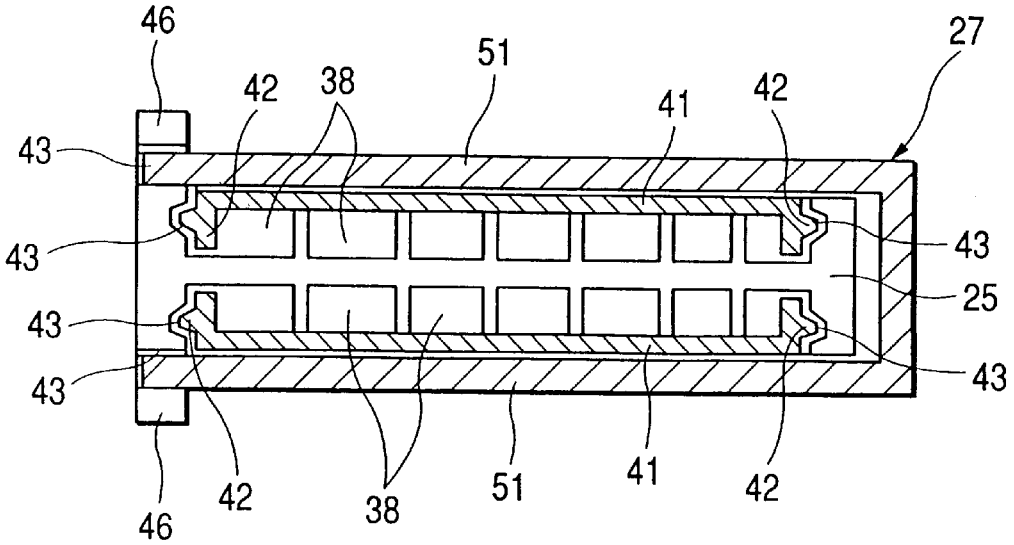
FIG. 3 is a sectional view showing relationships between a cover member of the male connector and a lever.

In FIG. 1, the connector 20 has a male connector 26 and a lever 27 as shown in FIG. 2. The connector 20 is to connect bus bars on a wiring board, which are laid between upper and lower covers, and the end portions of a wire harness.

As shown in FIG. 1, the connector 20 comprises: a female connector section 23 including a hood 23 integral with an upper cover housing section 21; a male connector 26 having a connector body 25 which is fitted in the hood section 22 of the female connector section 23; and a lever 27 which is set outside the connector body of the male connector 26 to fit the connector body 25 in the hood 22 of the female connector section 23.

In the female connector section 23, the end portions of the bus bar are accommodated in the housing section 21, and the male terminal portions (not shown) of the terminal portions are extended in the hood section 22. Rib guide grooves 28 and 28 are formed on the front end of the hood section 22 in such a manner that they are protruded on both sides of the front end of the hood section 22. An outer wall 29 forming the rib guide grooves 28 and 28 have a pair of notches 30 and 30. The ribs 46 and 46 (described later) of the connector body 25 are inserted in the rib guide grooves 28 and 28, and the protrusions 52 and 52 of lever walls 51 and 51 (described later) are fixedly inserted in the notches 30 and 30.

Figure 5:
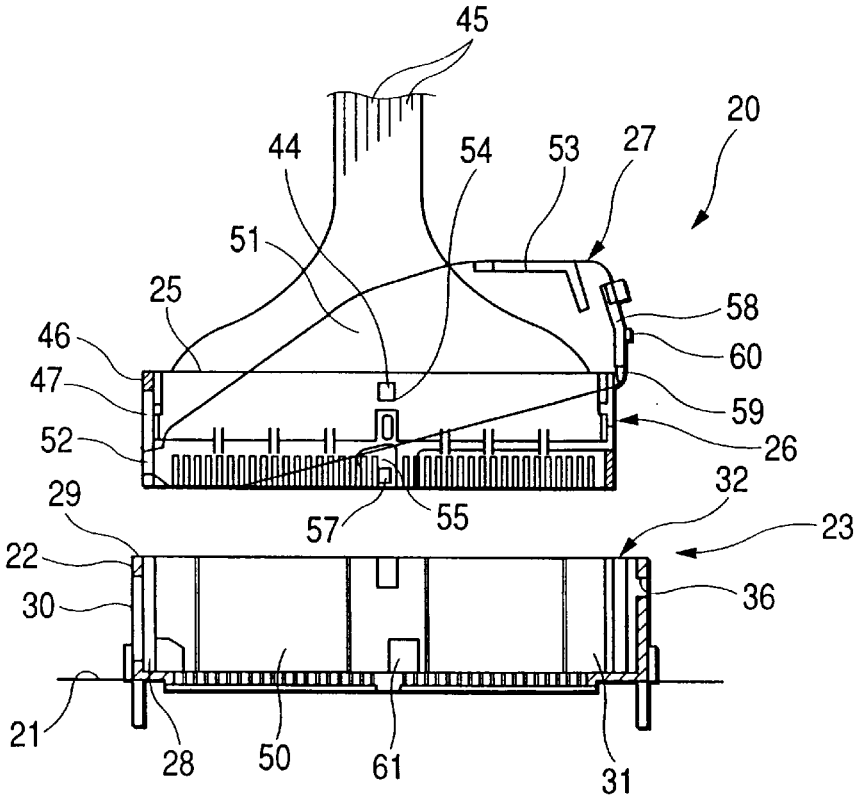
FIG. 5 is a sectional view showing the male connector which is not fitted in a female connector section yet.
Figure 6:
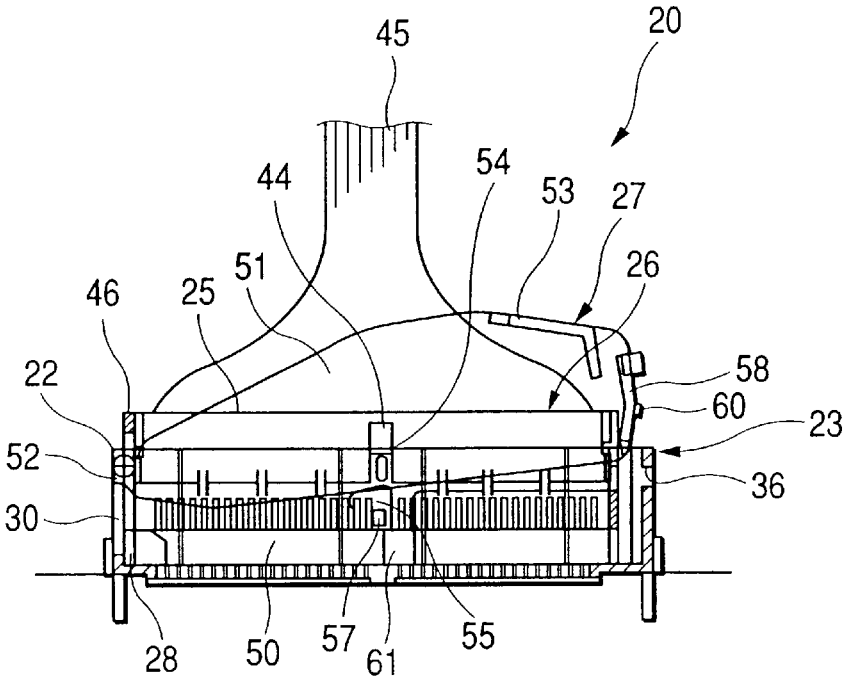
FIG. 6 is a sectional view showing an initial state that the male connector is inserted in the female connector section.

On the other side of the hood section 22, guide grooves 31 and 31 are formed in such a manner that they are extended outwardly. The guide ribs 49 and 49 of the connector body 25 are inserted in the guide grooves 31 and 31. A lever lock section 32 is provided on the rear end side which is closer to the end of the female connector section than those guide grooves 31 and 31. The lever lock section 32 has a pair of guide walls 33 and 33 which are protruded inwardly of the hood section 22. The space between those guide walls 33 and 33 is a lock piece inserting space 34. The outer wall 35, from which the guide walls 33 and 33 are protruded, has a notch (as shown in FIGS. 5 and 6). The locking piece 58 of the lever 27 inserted in the locking piece inserting space 34 is locked to the notch 36.

The connector body 25 of the male connector 26 is fitted in the hood section 22 by the operation of the lever 27, and the female terminals 37 (cf. FIG. 4) accommodated in the connector body 25 are electrically connected to the male terminal portions of the bus bar.

Figure 4:
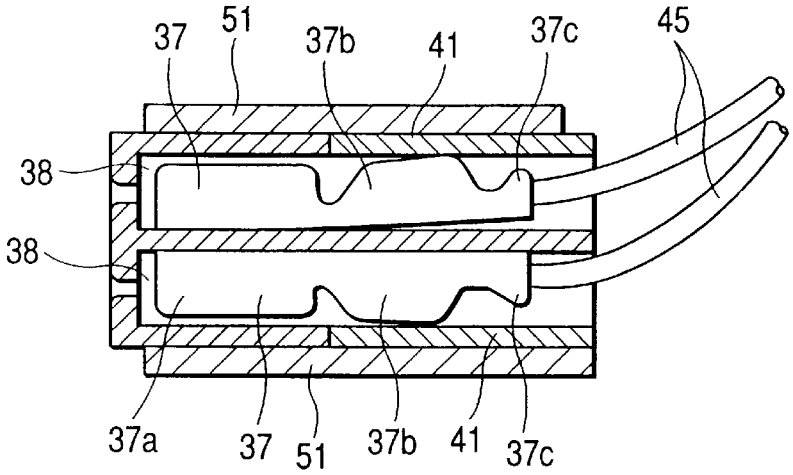
FIG. 4 is a sectional view showing relationships between the cover member and the lever.

The male connector 26 is designed as follows: That is, in the connector body 25, a plurality of terminal accommodating chambers 38 are formed in such a manner that they are arranged in two lines. Those terminal accommodating chambers 38 accommodate the female terminals 37, respectively. The female terminals 37 are so-called "press-fitting terminals". That is, each press-fitting terminal, as shown in FIG. 4, comprises a contact section 37*a* which is brought into contact with the mating terminal, a crimping section 37*b* in which a wire terminal is press-fitted, and a holding section 37*c* adapted to hold the terminal of a wire. The crimping section 37*b* has crimping blades which breaks the insulating cover of the wire thus press-fitted.

Both side walls 39 and 39 of the connector body 25 have openings 40 and 40 which open part of the terminal accommodating chambers. Through the openings 40 and 40, the press-fitting terminals 37 are inserted into the terminal accommodating chambers 38. The openings 40 and 40 are closed with cover members 41 and 41. Locking protrusions 42 and 42 are extended from both sides of each of the cover members 41. The locking protrusion 42 and 42 are engaged with the locking grooves 43 and 43 of the connector body 25, so that the cover members 41 are held on the connector body 25.

The cover members 41 have cylindrical bosses 44 and 44 on the outer peripheral surfaces. The bosses 44 are inserted in rotary holes 54 formed in the lever walls 51. Under the condition that the openings 40 are closed with the cover members 41, a plurality of wires 45 are pulled out of the rear end (the upper side in FIG. 1) of the connector body 25.

In addition, ribs 46 and 46 are protruded from both side walls 39 and 39 of the connector body 25. Those ribs 46 and 46 are inserted in the rib guide grooves 28 and 28, respectively, when the connector body 25 is fitted in the hood 22. The ribs 46 and 46 have elongated holes 47 and 47 which are elongated in the direction of engagement of the connector body 25 with the hood 22. The protrusions 52 and 52 of lever walls 51 and 51 (described later) are inserted in the elongated holes 47 and 47.

With respect to both side walls 39 and 39, play-preventing build-ups 48 and 48 are formed on the side of engagement of the connector body 25 in such a manner that they are located below the bosses 44 and 44. The guide ribs 49 and 49 are protruded from those build-ups 48 and 48, respectively. The lever 27 is set in such a manner as to cover the connector body 25.

The lever 27 comprises: a pair of lever walls 51 and 51 which are rotatably held between both side walls 39 and 39 of the connector body 25 and the inner walls 50 and 50 of the hood 22, and regulates the bending of the cover members 41 and 41; protrusions 52 and 52 which are provided on one side of the pair of lever walls 51 and 51 and are engaged with the hood 22 when the connector body 25 is engaged with the hood 22; and an operating section 53 which couples the other sides of the lever walls 51 and 51 to each other, and engages the connector body 25 with the hood 22 when the lever walls 51 and 51 are turned around the portions where the protrusions 52 and 52 are locked to the hood 22.

Each of the lever walls 51 has a rotary hole 54 substantially at the center. The bosses 44 are inserted into the rotary holes 54, so that the lever walls 51 are rotatable on the surfaces of the side walls 39 of the connector body 25. In addition, flexible temporary locking arms 55 are protruded from the lower ends of the lever walls 51. The temporary locking arms 55 have temporary locking holes 56, respectively. Temporary locking protrusions 57 extended from the side walls 39 of the connector body 25 are fixedly inserted in those temporary locking holes 56. As a result, the lever walls 51 are set with respect to the connector body 25; more specifically, the protrusions 52 are held at the lower portions of the elongated holes 47, respectively.

On the side of the operating section 53 between the lever walls 51 and 51, as shown in FIGS. 5 and 6, a lock piece 58 is formed integral with the inner surfaces of the lever walls 51 and 51 through a flexible arm 59. The lock piece 58 has a locking protrusion 60, which is locked to the aforementioned notch 36.

The behavior of the lever 27 is as follows: When, as shown in FIG. 2, the lever 27 is set in such a manner as to cover the connector body 25 and temporarily fixed, the protrusions 52 of the lever walls 51 are positioned at the lower portions of the elongated holes 47; that is, the temporary locking protrusions 57 are fitted in the temporary locking holes 56. Under this condition, the lever walls 51 regulates the outward bending of the cover members 41.

Now, steps of fitting the male connector 26 in the female connector section 23 in the connector 20 thus constructed, will be described.

Figure 7:
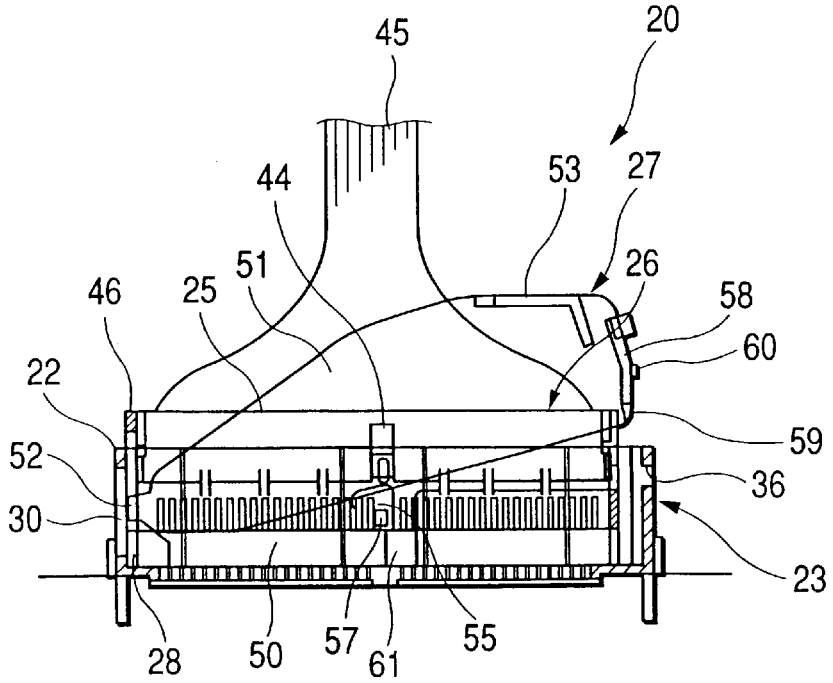
FIG. 7 is a sectional view showing a state that the protrusions of a lever are fixedly inserted in notches.

Under the condition that, as shown in FIGS. 2 and 5, the lever 27 is set in such a manner as to cover the connector body 25; that is, it is temporarily positioned, as shown in FIG. 6 the connector body 25 is inserted into the hood 22. Thereafter, as shown in FIG. 7, the protrusions 52 of the lever 27 are fixedly inserted in the notches 30.

Figure 8:
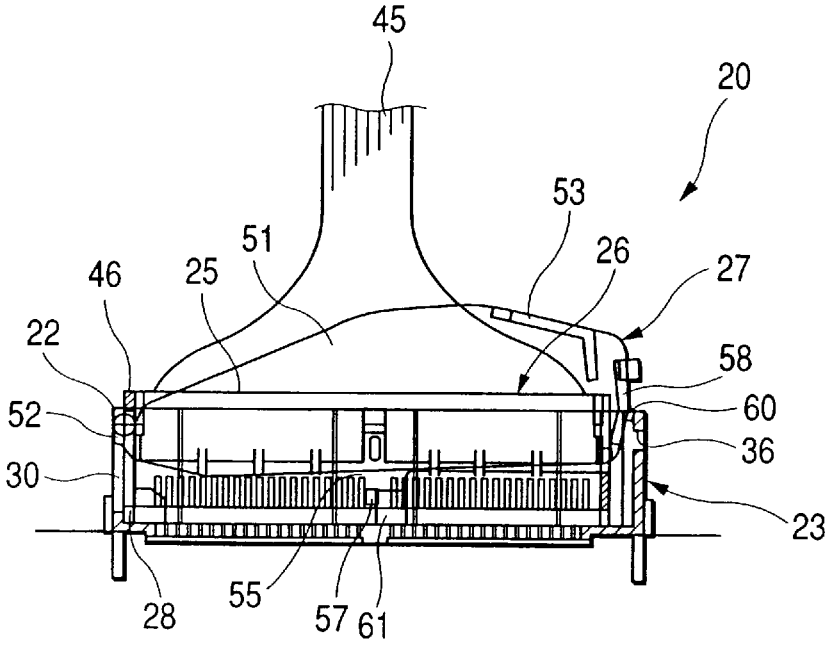
FIG. 8 is a sectional view showing a state that the lever is turned to insert the connector body in the hood.

Under this condition, the operating section 53 is depressed to turn the lever walls 51 around the bosses 44. As a result, the lever walls 51 are turned around the locking portions of the protrusions 52 through which the latter are locked to the notches 30. Therefore, as shown in FIG. 8, the connector body 25 is inserted in the hood 22. In this operation, the temporary locking arm 55 is forcibly outwardly bent by the releasing protrusion 61 which is formed on the inner wall 50 of the hood 22, so that the temporary locking protrusion 57 is disengaged from the temporary locking holes.

As a result, the lever 27 (which has been temporarily locked) becomes rotatable with respect to the connector body 25; that is, the lever 27 can be turned around fulcrums where protrusions 52 are locked to the notches 30. Then, as shown in FIG. 9 when the lever 27 is fully turned, the connector body 25 is fully fitted in the hood 22, and under this condition the locking protrusion 60 of the lock piece 58 is locked to the notch 36, which prevents the unintentional turn of the lever 27.

Figure 9:
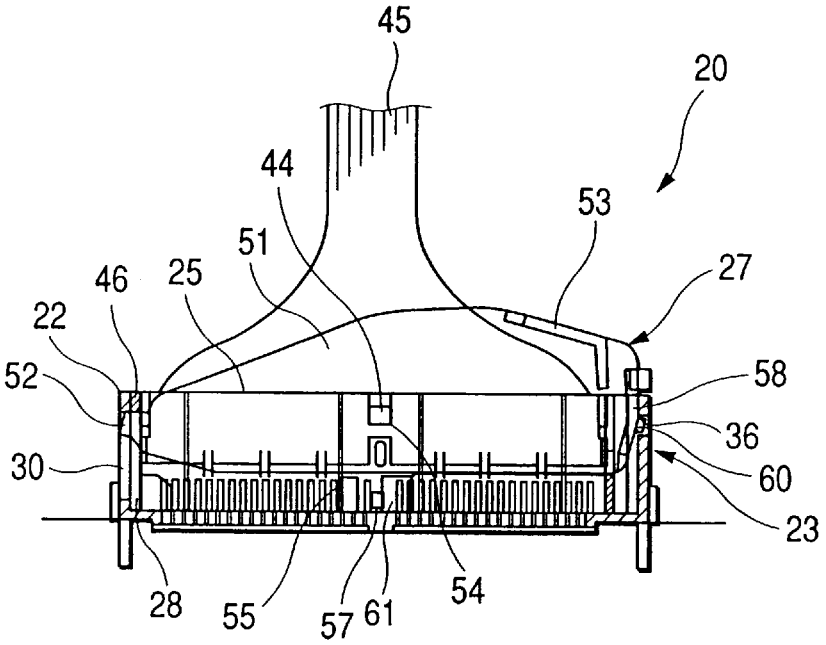
FIG. 9 is a sectional view showing a state that the connector body has been completely inserted in the hood.
Figure 10:
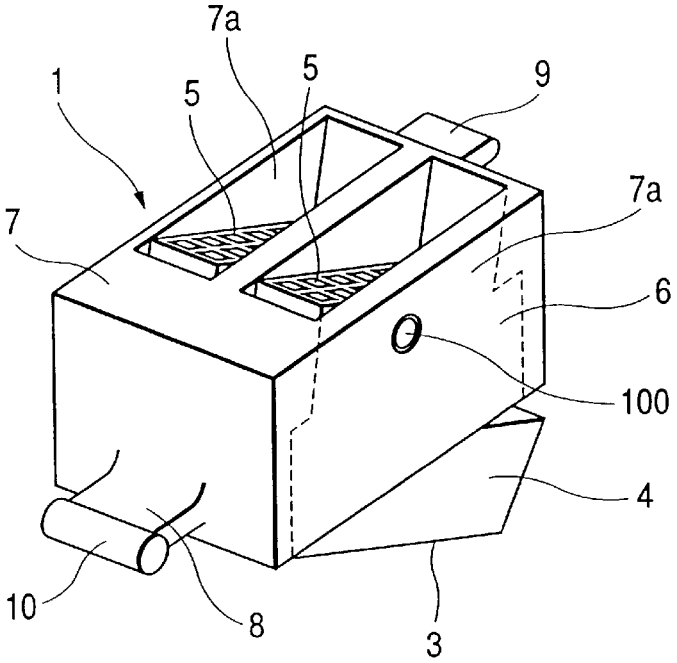
FIG. 10 PRIOR ART
FIG. 10 is a perspective view showing a conventional frame-coupled connector.
Figure 11:
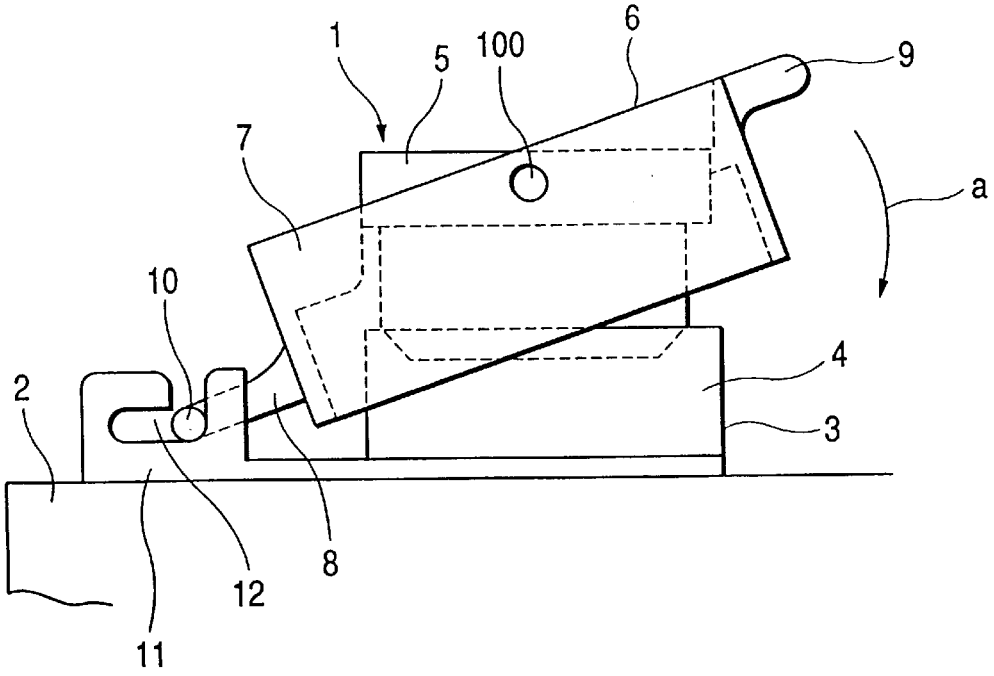
FIG. 11 PRIOR ART
FIG. 11 is a side view for a description of the operation of the frame-coupled connector shown in FIG. 10.
Figure 12:
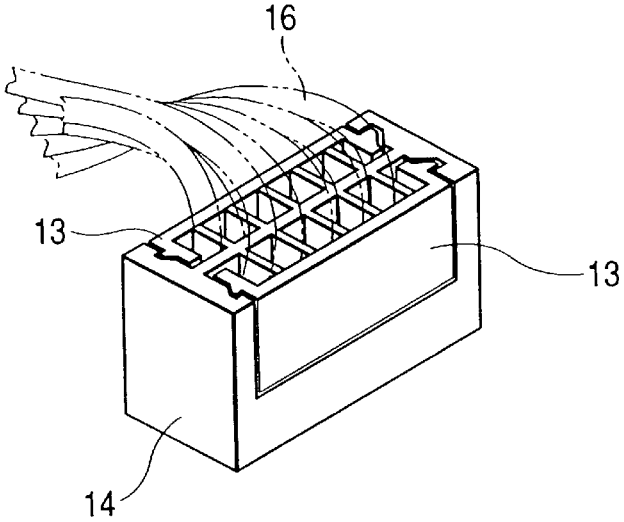
FIG. 12 PRIOR ART
FIG. 12 is a perspective view showing a state that, in a connector having a cover, the cover member is bent.
Figure 13:
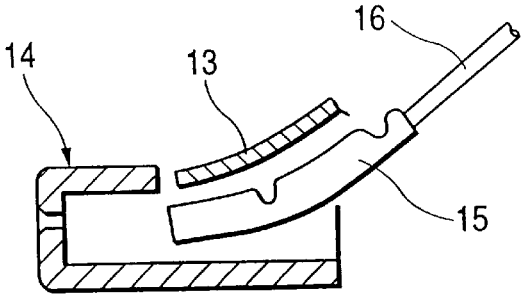
FIG. 13 PRIOR ART
FIG. 13 is a sectional view showing a state that, in a connector having a cover, a wire is laid over.
Figure 14:
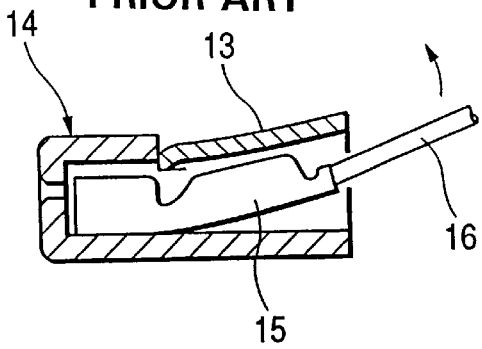
FIG. 14 PRIOR ART
FIG. 14 is a sectional view showing the deformation of a terminal in a connector having a cover which may occur when the wire is laid over.

The connector body 25, which, as shown in FIG. 9 is completely fitted in the hood 22, may be pulled out of the hood 22 as follows:

Under the condition that the lock piece 58 is bent to disengage the locking protrusion 60 from the notch 36, the operating section 53 is operated to turn the lever walls 51 in the direction opposite to the aforementioned direction. As a result, the connector body 25 is disengaged from the hood 22, and set at the temporary locking position as shown in FIG. 7. Under this condition, the connector body 25 is pulled upwardly of the hood 22. Thus, the connector body 25 has been pulled out of the hood 22.

When the wires 45 pulled out from the wire pull-out side of the connector body 25 are pulled or twisted, in the connector 20 the cover members 41 tend to bend outwardly; however, the bending of the cover members 41 is prevented by the lever walls 51. The walls 51 are rotatably held between the side walls 39 of the connector body 25 and the inner walls 50 of the hood 22. Therefore, even if the lever walls 51 tend to bend outwardly, the bending of the latter 51 is prevented by the inner walls 50 of the hood 22. As a result, even if the cover members 41 depress the lever walls 51 outwardly thereby to bend outwardly, the bending of the lever walls 51 is prevented by the inner walls 50 of the hood 20; that is, the bending of the cover members can be positively prevented.

In the embodiment, when the lever walls 51 are turned around fulcrums of the locking portions where the protrusions 52 are locked to the hood 22, the protrusions 52 of the lever walls 51 are turned while being guided by the elongated holes 47 formed in the connector body 25. Even before the connector body 25 is fitted in the hood 22, the protrusions 52 of the lever walls 51 have been inserted in the elongated holes 47. Therefore, even if, under this condition, the wires are pulled or twisted, the bending of the cover members 41 can be prevented.

Furthermore, since the bending of the cover members 41 is prevented by the lever walls 51, the wall thickness of the cover members 41 can be decreased, which contributes to the miniaturization of the connector 20.

As was described above, since the bending of the cover members 41 is prevented by the lever walls 51, no external force is applied to the female terminals; that is, the female terminals are positively prevented from being deformed.

With the connector of the present invention, when the wires pulled out of the wire pull-out side of the connector body are pulled or twisted, the cover members tend to bend outwardly to push the lever walls outwardly; however, the bending of the lever walls is regulated by the inner walls of the hood; that is, the bending of the cover members is positively prevented.

Furthermore, in the connector, the bending of the cover members covering both sides of the connector body is regulated by the pair of lever walls, and the bending of the pair of lever walls is regulated by the inner walls of the hood. As a result, the bending of the cover members is regulated, and therefore the connector is free from the difficulty that the cover members are bent when the wires are pulled or twisted.

Moreover, in the connector, when the lever walls are turned around fulcrums of the locking portions where the protrusions are locked to the hood, the protrusions of the lever walls are turned while being guided by the guide slits. Even before the connector body is fitted in the hood, the protrusions of the lever walls have been inserted in the guide slits. Therefore, even if, under this condition, the wires are pulled or twisted, the bending of the cover members can be prevented.

While there has been described in connection with the preferred embodiment of the invention, it will be obvious to those skilled in the art that various changes and modifications may be made therein without departing from the invention, and it is aimed, therefore, to cover in the appended claim all such changes and modifications as fall within the true spirit and scope of the invention.

What is claimed is:

1. A lever-engaged connector comprising:

a female connector having a hood with recessed portions and a housing which accommodates male terminals, said hood and said housing being integrally formed;

a male connector including a connector body which has terminal accommodating chambers for accommodating female terminals to be connected to said male terminals and a cover member for covering said terminal accommodating chambers, said cover member being disposed adjacent a wire-lead-out side of said terminal accommodating chambers; and a lever for inserting said connector body of said male connector in said hood and removing said connector body from said hood, wherein said lever comprising:

a pair of lever walls for preventing said cover members from bending, said lever walls rotatably interposed between both side walls of said connector body and inner walls of said hood, protrusions formed on one side of said pair of lever walls for engaging with said recessed portions of said hood when said connector body is fitted in said hood, and an operating portion through which the other side of said pair of lever walls are coupled to each other, and which operatively turns said lever walls around contacting portions of said protrusions where said protrusions are contacted with said recessed portions of said hood, to cause said connector body to fit in said hood.

2. A lever-engaged connector as claimed in claim 1, wherein said cover member is provided on both side surfaces of said connector body, and the bending of said cover member is prevented by said pair of lever walls.

3. A lever-engaged connector as claimed in claim 1, wherein said connector body has guide slits into which said protrusions of said lever walls are inserted for guiding protrusions when said lever walls are turned.

4. A lever-engaged connector as claimed in claim 2, wherein said connector body has guide slits into which said protrusions of said lever walls are inserted for guiding said protrusions when said lever walls are turned.

* * * * *